US005967006A

United States Patent [19]

Hillinger

[11] Patent Number: 5,967,006

[45] **Date of Patent: *Oct. 19, 1999**

[54] LINEAR DRIVER WITH A GRIP ENHANCING THUMB PLATE

[75] Inventor: George Hillinger, Beverly Hills, Calif.

[73] Assignee: Alltrade Inc., Long Beach, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/135,234

[22] Filed: Aug. 17, 1998

[51] Int. Cl.[6] ..... B25G 1/01

[52] U.S. Cl. ..... 81/489; 81/177.1; 81/177.5; 81/177.6

[58] Field of Search ..... 81/489, 177.1, 81/177.5, 177.6; D8/82, 83, 81, 87, 84

[56] References Cited

U.S. PATENT DOCUMENTS

| | | | |
|---|---|---|---|
| D. 241,806 | 10/1976 | Johnson . | |
| 859,006 | 7/1907 | Newley . | |
| 1,161,270 | 11/1915 | Vance . | |
| 2,487,155 | 11/1949 | Loewy | 145/61 |
| 2,938,555 | 5/1960 | Paajanen | 145/61 |
| 3,863,693 | 2/1975 | Carriker | 145/50 |
| 4,895,044 | 1/1990 | Elkins . | |
| 5,595,095 | 1/1997 | Hillinger . | |

OTHER PUBLICATIONS

The Grantley Company, Annapolis Junction, Maryland "Triple Torque Screwdriver" Flyer—Published prior to 1998.

*Primary Examiner*—David A. Scherbel
*Assistant Examiner*—Shantese McDonald
*Attorney, Agent, or Firm*—Robert R. Thornton

[57] ABSTRACT

A linear driver has a drive stem having a first end and a second end and a handle fixed the drive stem so that the drive stem first end extends into a first end of the handle. In order to increase the torque the user may apply to the driver, the driver includes a thumb plate fixed when in its operating position with respect to the drive stem so that the thumb plate extends radially outwardly from the handle at the handle first end so as to permit its engagement by the thumb of a user. The thumb plate may be selectively retractable into the handle when not in use in certain embodiments of the invention, while, in others, the thumb plate remains fixed in its operating position.

9 Claims, 4 Drawing Sheets

LINEAR DRIVER WITH A GRIP ENHANCING THUMB PLATE

SUMMARY OF THE INVENTION

The present invention relates to linear drivers, such as screwdrivers and linear socket drivers, and provides for a driver with which the user can apply increased torque to the fastener being driven into or removed from a work piece over that which the same user could apply when using a conventional linear driver of the same type.

The ability of a user of a linear driver to apply torque to a fastener is limited by the strength of the user's grip on the driver handle. Thus, if the user's grip in not sufficiently strong, the user will be unable to apply sufficient torque to the fastener to complete the task. On occasion, the user may even grip the driver with one hand and grip that hand with the other in an attempt to increase the user's ability to apply torque to the fastener through the driver, but with limited success on many occasions.

According to the present invention, a linear driver has a drive stem having a first end and a second end and a handle fixed to the drive stem so that the drive stem first end extends into a first end of the handle and includes a thumb plate fixed with respect to the drive stem so that the thumb plate extends radially outwardly from the handle at the handle first end in an operating position which permits its engagement by the thumb of a user in order to increase the torque the user may apply to the driver. The thumb plate may be selectively retractable into the handle when not in use in certain embodiments of the invention, while, in others, the thumb plate remains fixed in its operating position.

DESCRIPTION OF THE DRAWING

The invention may be more readily understood by reference to the accompanying drawing, in which.

DETAILED DESCRIPTION OF THE PREFERRED EMBODIMENTS

Figures 1, 2, 4:
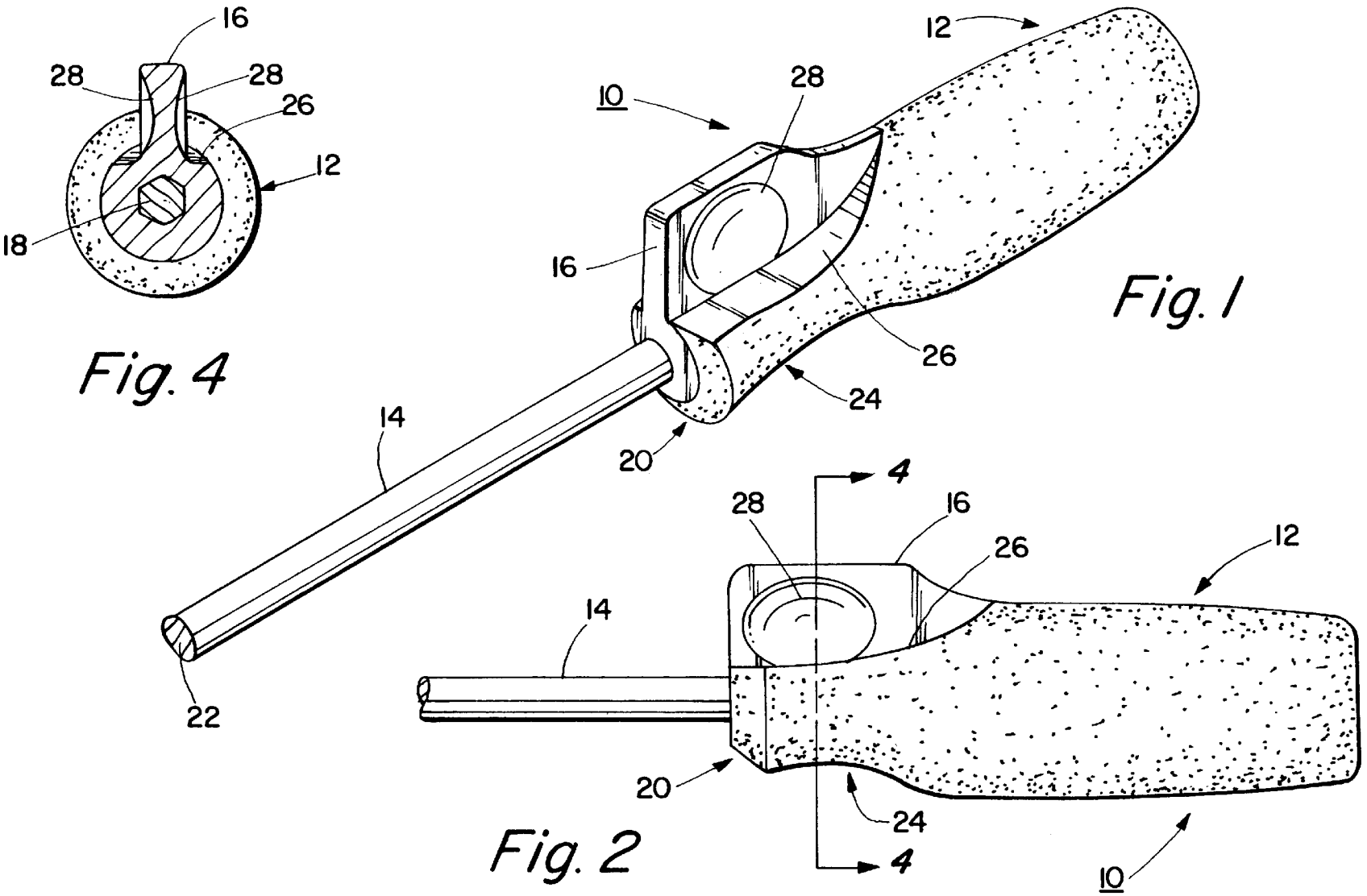
FIG. 1 is a view, in perspective, of a linear driver with a torque-aiding thumb support according to my present invention.
FIG. 2 is a left side elevational view of the driver of FIG. 1.
FIG. 4 is a view, in section, taken along lines 4—4 of FIG. 2.
Figure 3:
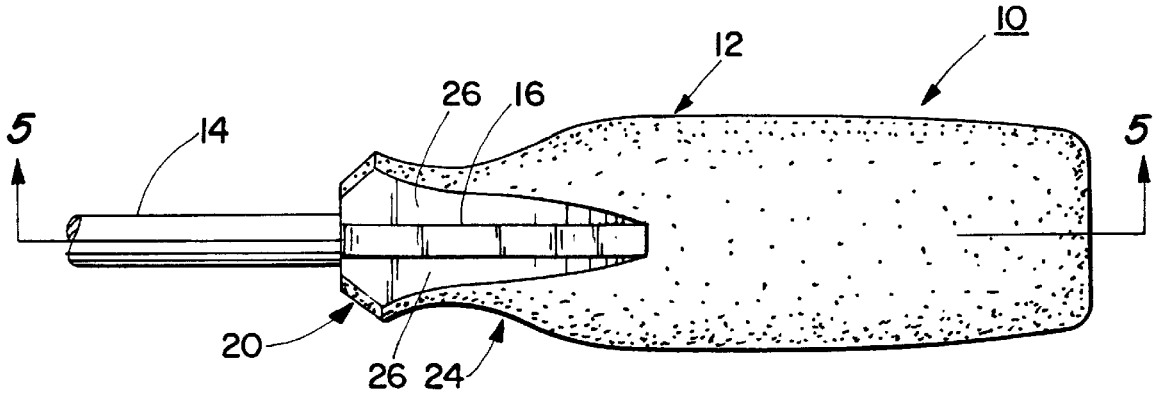
FIG. 3 is a plan view of the driver of FIG. 1.
Figure 5:
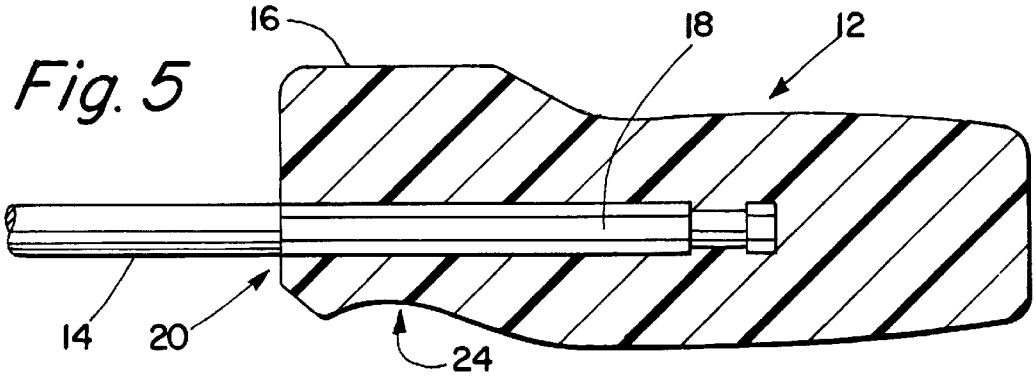
FIG. 5 is a view, in section, taken along lines 5—5 of FIG. 3.
Figure 6:
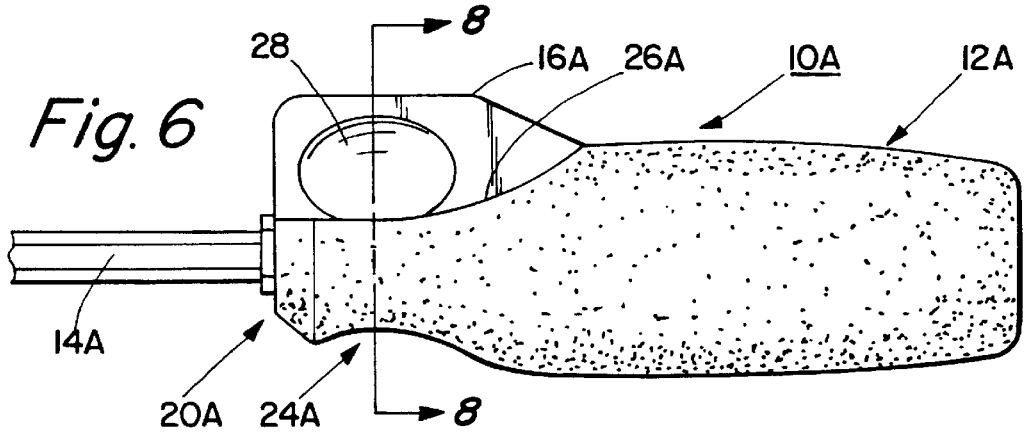
FIG. 6 is left side elevational view of an alternate embodiment of the driver of FIG. 1.
Figure 7:
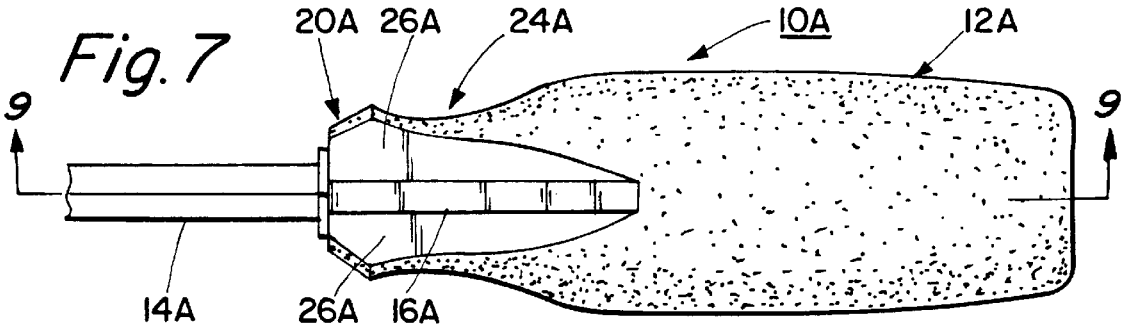
FIG. 7 is a plan view of the driver of FIG. 6.
Figure 8:
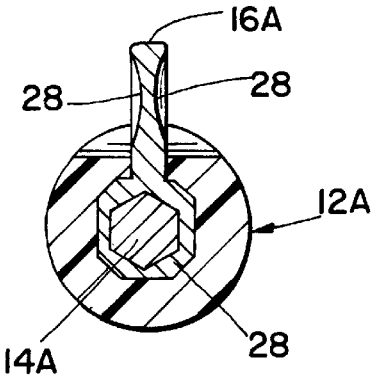
FIG. 8 is a view, in section, taken along lines 8—8 of FIG. 6.
Figure 9:
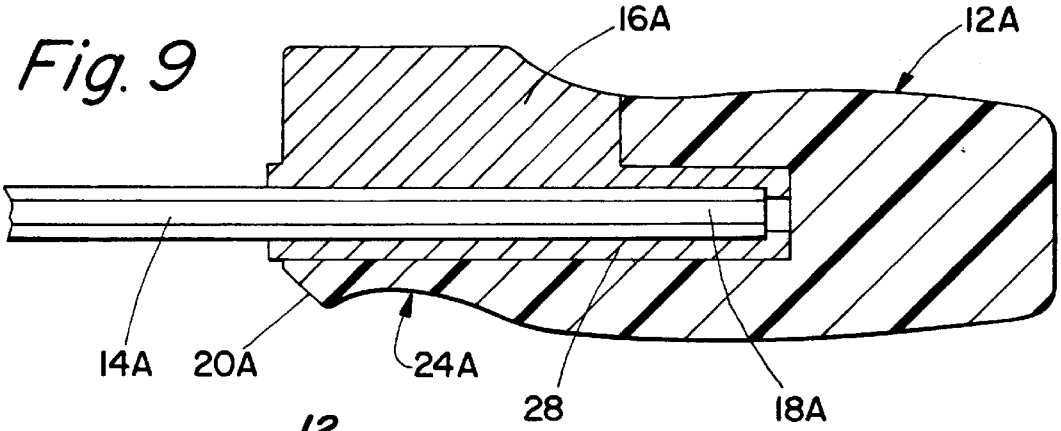
FIG. 9 is a view, in section, taken along lines 9—9 of FIG. 7.
Figure 10:
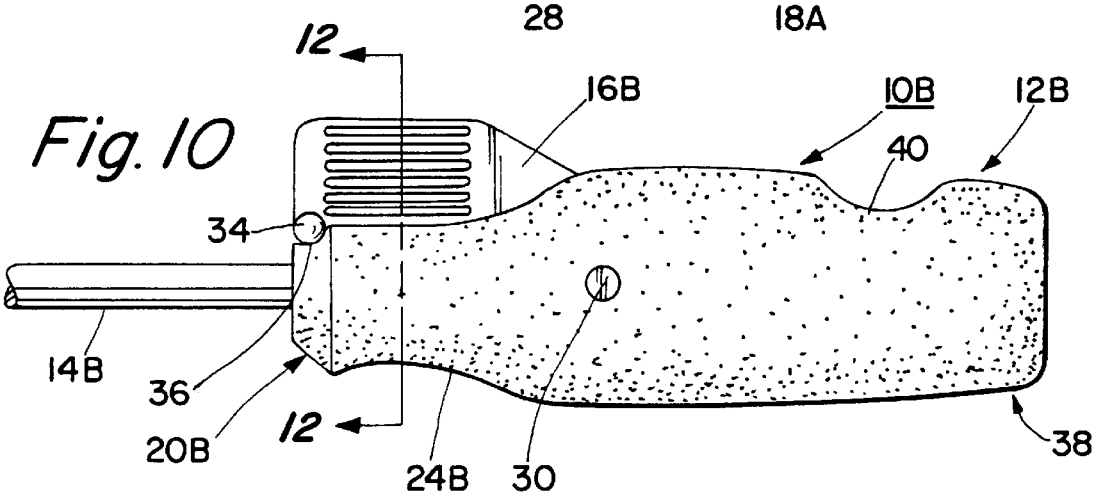
FIG. 10 is a left side elevation of a second alternate embodiment of the driver of FIG. 1.
Figure 11:
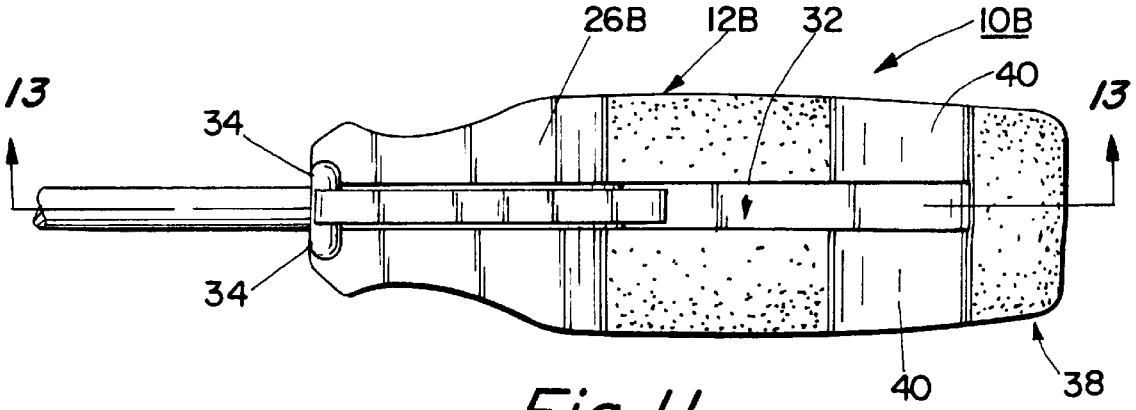
FIG. 11 is a plan view of the driver of FIG. 10.
Figure 12:
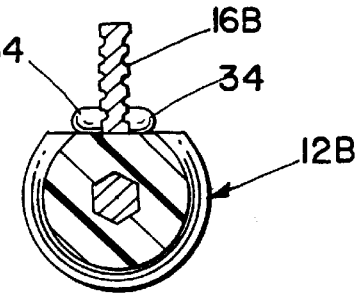
FIG. 12 is a view, in section, taken along lines 12—12 of FIG. 10.

Referring first to FIGS. 1 through 5, there is shown a linear driver 10 according to the present invention. The linear driver 10 has a handle 12, drive stem 14, and thumb plate 16. The drive stem 14 is shown as circular in cross-section over most of its length and terminates at a first end 18 which is hexagonal in cross-section within the handle 12 (see FIG. 4) as it extends through a first handle end 20 (see FIG. 5) to facilitate the locking of the drive stem 14 to the handle 12 to prevent rotational movement therebetween when the linear driver 10 is in use. The drive stem 14 may terminate at a second end 22 (see FIG. 1) as a screwdriver blade, or as a fixed socket, or as a square drive, or as a hex drive, etc., (not shown), as desired, as is conventional practice for linear drivers.

In the embodiment of linear driver shown in FIGS. 1 through 5, the thumb plate 16 is formed unitarily with the handle 12 as a single element (see FIG. 4) of any desired material, such as an appropriate plastic, as is well known in the art. If desired, in order to facilitate the gripping of the handle 12 by a user, the outer surface of the handle 12 may be covered with a resilient material or formed so as to have a gripping surface, such as that-shown in my U.S. Pat. No. 4,951,533, issued Aug. 28, 1990, for example. The handle tapers to a neck portion 24 adjacent the handle first end 20, which is adapted to receive the index finger of the user to facilitate the application of manual torque to the handle 12 and so the drive stem 14.

The neck portion 24 has a cutaway surface 26 adjacent the thumb plate to facilitate the access of the user's thumb to the thumb plate 16. A pair of thumb receiving recesses 28 are formed opposite one another on the thumb plate 16 (see FIGS. 2 and 4) to facilitate location and retention of the user's thumb on the thumb plate 16, irrespective of the direction of rotation of the linear driver 10 by the user.

Referring now to FIGS. 6 through 9, a linear driver 10A is shown, which is an alternate embodiment of the linear driver 10 of FIGS. 1 through 5. The linear driver 10A differs from the linear driver 10 principally in that the linear driver 10A has a thumb plate 16A and a handle 12A which are not unitarily formed, but rather are separately formed, so that, if desired, the thumb plate 16A may be of a different material, such as a different type or color of plastic or of metal rather than plastic, from that of the handle 12A. The linear driver 10A has a drive stem 14A which is shown for illustrative purposes as hexagonal in cross-section, rather than the partially round, partially hexagonal cross-section of the drive stem 14. Obviously, any appropriate non-circular cross-section could be used to facilitate the attachment, although a circular cross-section with or without additional attachment features, such as a pin and slot or other well known attachment systems, can be used if otherwise acceptable. The thumb plate 16A has a base portion 28, through which a longitudinal passage extends and which is complementary in cross-section to the cross-section of the drive stem 14A portion 18A within the handle 12A. The exterior surface of the portion of the thumb plate 16A enclosing the drive stem portion 18A is irregular, such as being hexagonal, in order to facilitate the locking of the thumb plate 16A, and so the drive stem 14A, to the handle 12A in conventional fashion, as by molding.

A second alternate embodiment of the linear driver of the present invention is shown in FIGS. 10 through 13, in which a linear driver 10B is shown as having a handle 12B and a drive stem 14B. A thumb plate 16B is pivotally attached to the handle 12B by means of a pivot pin 30 so as to be disposed in a longitudinal recess 32 (see FIG. 11) formed in the handle 12B. The thumb plate 16B has a pair of stop pins 34 extending transversely therefrom which engage a stop shoulder 36 formed on the handle first end 20B. The handle 12B has a second end 38 which is remote from the drive stem 14B, and has an arcuate access shoulder 40 formed thereon so as to extend transversely there across (see FIG. 11). The shoulder 40 acts as a stop for the thumb plate 16B when it is pivoted clockwise away from its operating position shown in FIG. 13 in solid lines to its storage position shown in FIG. 13 in dotted lines.

The position of the thumb plate 16B, whether operating or storage, in maintained against inadvertent change by a ball detent mechanism, consisting of a ball 42 positioned against a spring 44 formed in a recess 46 in the handle first portion 20B so as to abut the drive stem first end 18B. The spring 44 holds the ball 42 against a camming surface 48 formed on a thumb plate arm 50 (see FIG. 13), and by causing the ball 42 to engage one of two detent recesses formed on the camming surface 48, holds the thumb plate 16B in the desired operating or storage position. The thumb plate 16B is selectively moved from one position to the other by manually rotating the thumb plate to overcome the ball detent spring mechanism pressure.

Figure 13:
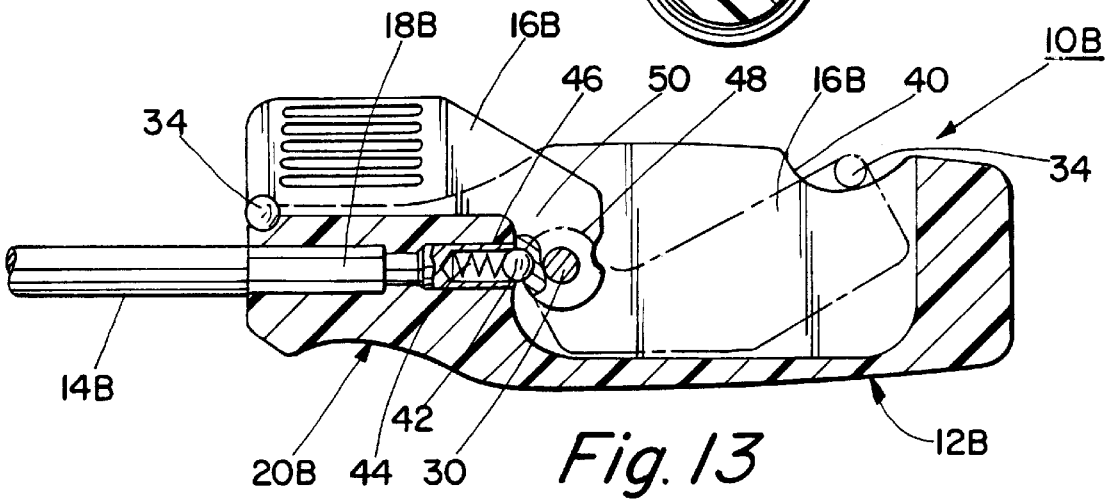
FIG. 13 is a view, in section, taken along lines 13—13 of FIG. 11.
Figure 14:
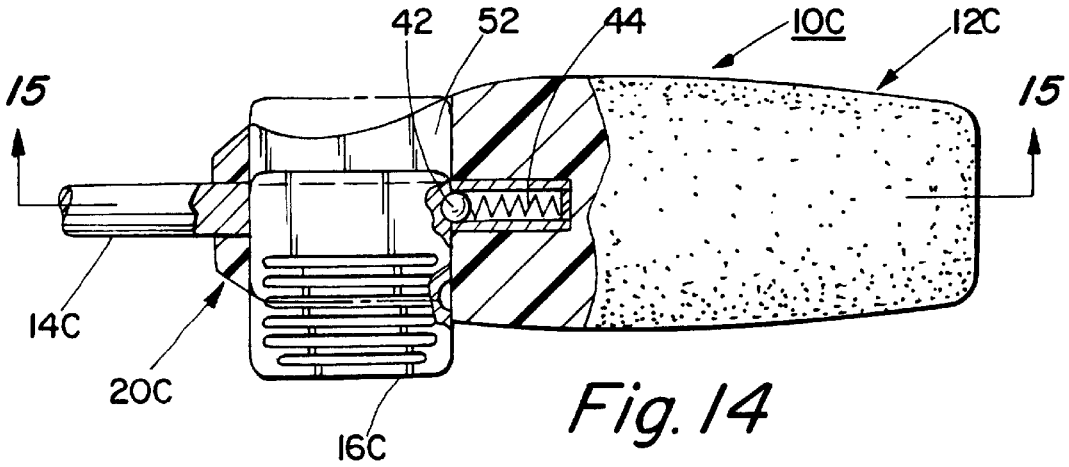
FIG. 14 is a right side elevational view, partially in section, of a third alternate embodiment of the driver of FIG. 1.
Figure 15:
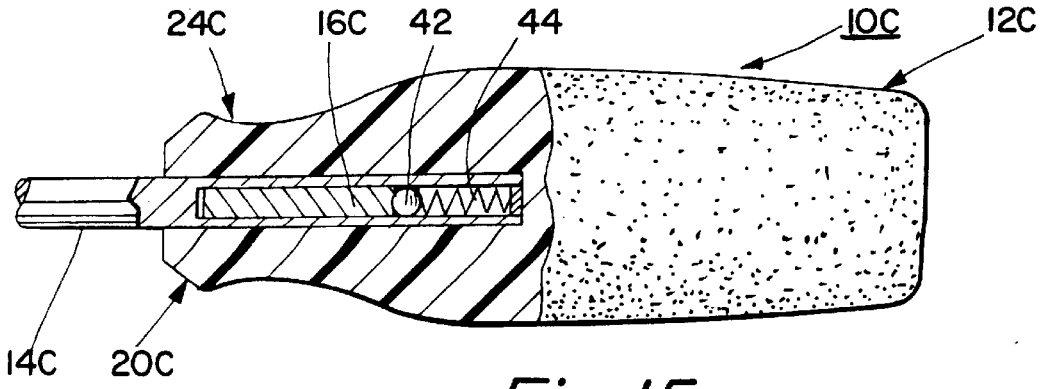
FIG. 15 is a plan view, partially in section, of the driver of FIG. 14.

Referring now to FIGS. 13 and 14, a third alternate embodiment of a linear driver according to the present invention is shown as a linear driver 10C, which has a thumb plate 16C. The thumb plate 16C is disposed in a transverse slot 52 formed in the handle 12C at the first end 20C thereof, and is selectively manually slidable between its operating position shown in solid lines in FIG. 14 and a storage position shown in dotted lines in FIG. 14. The thumb plate 16C is held in the desired position by a ball detent mechanism similar to that described with respect to the embodiment of FIGS. 10 through 13. The ball 42 is held against the thumb plate 16C by the spring 44 which is contained within the handle 12C in the same manner as with the preceding embodiment. The ball engages a selected one of two detent recesses formed on the thumb plate 16C to hold the thumb plate 16C in its operating position or in its storage position, as desired.

As is apparent from a comparison of the embodiments of FIGS. 1 through 5 and 6 through 9 with the embodiments of FIGS. 10 through 13 and 14 and 15, the thumb plate may be either fixed (FIGS. 1–9) or retractable (FIGS. 10–14). The use of a fixed thumb plate as the support for the thumb in order to enable the user to exert additional torque through the drive stem to the fastener has the advantages of simplicity of manufacture and strength, whereas the use of a retractable thumb plate enables the overall size of the linear driver to be reduced when the thumb plate is in its retracted position awaiting extension for use.

The operation of the various embodiments of the linear driver of the present invention, while apparent from the foregoing descriptions of the embodiments, is as follows:

If appropriate for the particular embodiment, the thumb plate is moved from its retracted position to its operating position;

The drive stem, through whatever fastener engaging device is integral therewith or attached thereto, engages the fastener to which torque is to be applied;

The user grips the handle with the fingers and palm of the hand;

The user's thumb is placed against the thumb plate on the appropriate side to urge the handle in the desired rotary direction; and The user, while gripping the handle and pressing against the thumb plate, attempts to rotate the handle in the desired direction.

The novel linear driver as described above in its presently preferred embodiments provides a driver which is strong, easy to use, and increases significantly the torque that an ordinary user is able to apply to a fastener. The amount of the increase appears to be dependent on the user, and to be related to the strength of the natural grip of the user. For a user with an exceptionally strong grip, in which the fingers and palm provide a strong clamping force on the driver handle, the relative torque increase provided by the use of the present invention is less than that provided to a user with a weaker grip, in which instance the thumb plate significantly adds to the torque which would otherwise be applied to the drive stem resulting from the user's weaker grip on the driver handle.

Although the presently preferred embodiments of the invention have been set forth herein in detail for illustrative purposes, it will be apparent to those skilled in the art that variations and modifications thereof lie within the scope of the present invention, which is not limited to the specific structures of the embodiments shown or described herein, but only by the scope of the following claims.

The invention claimed is:

1. In a linear driver, the combination of:

a linear drive stem having a first end and a second end;

a handle having a first end portion and a second end portion, the handle being fixed to the drive stem so that the drive stem first end extends into the handle first end portion and the handle second end portion is remote from the drive stem;

a thumb plate;

means for fixing the thumb plate with respect to the drive stem so that the thumb plate normally extends radially outwardly from the handle first end portion so as to be immediately adjacent the drive stem; and thumb plate grip enhancing means formed on the first end portion including a cutaway surface formed on the first end portion so as to be bifurcated by the thumb plate and to slope downwardly toward the drive stem, said cutaway surface being adapted to receive the user's thumb in longitudinal engagement therewith.

2. A driver according to claim 1, and in which the thumb plate is unitarily formed as a portion of the handle.

3. A driver according to claim 1, and in which the thumb plate is formed about the drive stem at the drive stem first end so as to be fixed directly thereto and extend through the handle first end.

4. A driver according to claim 1, and in which the means for fixing the thumb plate is selectively operable to permit the extension of the thumb plate from the handle and the retraction of the thumb plate into the handle.

5. A driver according to claim 4, and in which the means for fixing the thumb plate is selectively operable to permit the pivotal movement of the thumb plate between the position in which the thumb plate bifurcates the cutaway surface and a second position in which the thumb plate is retracted into the second end portion so as to be in axial alignment with and remote from the drive stem.

6. A driver according to claim 5, and including means for selectively locking the thumb plate in the position in which it bifurcates the cutaway surface and in the second position.

7. A driver according to claim 4, and in which the means for fixing the thumb plate is selectively operable to permit the transverse extension of the thumb plate from the handle to an operating position and the transverse retraction of the thumb plate into the handle to a storage position, and includes a slot formed in the handle adjacent the drive stem first end for receiving the thumb plate, and locking means selectively operable to permit the locking of the thumb plate in the operating position and in the storage position.

8. A driver according to claim 6, and including a pair of axially aligned stop pins formed on the thumb plate so as to extend laterally outwardly therefrom and to be operable to engage the first end portion to limit the rotation of the thumb plate toward the drive stem and be operable to engage the second end portion to limit the rotation of the thumb plate away from the drive stem.

9. A driver according to any one of the preceding claims, and in which the thumb grip enhancing means includes a reduced neck portion formed on the first end portion and adapted to receive a user's index finger in circular engagement therewith when the user's thumb is in engagement with the thumb plate.

* * * * *